United States Patent [19]

Huber et al.

[11] Patent Number: 4,506,249

[45] Date of Patent: Mar. 19, 1985

[54] FUSE ELEMENT TERMINATION FOR CURRENT-LIMITING FUSE

[75] Inventors: William J. Huber, Waukesha; Gordan T. Borck, Cudahy, both of Wis.

[73] Assignee: RTE Corporation, Waukesha, Wis.

[21] Appl. No.: 530,403

[22] Filed: Sep. 8, 1983

[51] Int. Cl.[3] ..... H01H 85/16

[52] U.S. Cl. ..... 337/232; 337/158

[58] Field of Search ..... 337/232, 231, 229, 228, 337/158, 159, 160, 244; 338/329

[56] References Cited

U.S. PATENT DOCUMENTS

| | | | |
|---|---|---|---|
| 2,343,224 | 2/1944 | Powell | 337/244 |
| 3,729,574 | 4/1973 | Weiner | 338/329 |
| 3,801,945 | 4/1974 | Howard | 337/159 |
| 4,090,164 | 5/1978 | Mikulecky | 337/231 |
| 4,146,862 | 3/1979 | Mikulecky | 337/158 |

*Primary Examiner*—Harold Broome

*Attorney, Agent, or Firm*—Raymond E. Fritz, Jr.

[57] ABSTRACT

A current-limiting fuse comprises a hollow insulating housing; metallic end cap assemblies at opposite ends of the housing; a multi-ribbed dielectric spider assembly having metallic terminator plates connected at opposite ends disposed within the housing with each terminator plate electrically and mechanically connected to an associated end cap assembly; a plurality of fusible elements helically wound on the spider assembly with their ends electrically and mechanically secured to the terminate plate; a visual indicator pin mounted on one end of the spider assembly and movable by a biasing spring from a retracted position wherein it is secured by a fusible wire to a tripped (fuse-blown) position wherein it projects through aligned holes in an associated terminator plate and end cap assembly; and granular dielectric material filling the housing. Each terminator plate comprises axially inwardly extending relatively massive arcing electrodes (one for each fusible element) around which end portions of the fusible elements are wound. Each end portion of an element extends either through a hole in the arcing electrode to which it is spot-welded or through a hole in the terminator plate to which it is welded. The fusible wire has one end mechanically secured to the pin, is helically wound through axially spaced apart holes formed in the ribs of the spider assembly, and has its other end mechanically anchored to a rib in the spider assembly.

7 Claims, 12 Drawing Figures

FUSE ELEMENT TERMINATION FOR CURRENT-LIMITING FUSE

BACKGROUND OF THE INVENTION

1. Field of Use

This invention relates generally to high voltage current-limiting cartridge-type electrical fuses.

In particular, it relates to improved means for terminating the ends of fusible elements, such as ribbons or wires, employed therein.

2. Description of the Prior Art

A high voltage current-limiting cartridge-type fuse typically comprises a hollow cylindrical insulating housing; electrically conductive end cap assemblies secured to opposite ends of the housing; a multi-ribbed dielectric spider assembly having electrically conductive metallic terminator plates connected at opposite ends disposed within the hollow housing with each terminator plate electrically and mechanically connected to an associated end cap assembly; a plurality of fusible ribbons helically wound on the spider assembly with an end of each ribbon electrically and mechanically secured to an associated terminator plate; an axially movable visual indicator pin mounted on one end of the spider assembly and movable by a biasing spring from a retracted position wherein it is secured by a fusible wire to a tripped (fuse-blown) position wherein it projects through aligned holes in an associated terminator plate and end cap assembly; and granular dielectric material, such as sand, filling the housing. U.S. Pat. No. 4,220,940 assigned to the same assignee as the present application illustrates a prior art fuse of the aforesaid character.

When a fuse of the aforesaid character is subjected to an electric overload in the circuit in which it is employed, the fusible element vaporizes, accompanied by temperatures on the order of 2000° F. occurring within the hollow housing, and arcing occurs between the points at which the fusible element was terminated. If a fusible element is terminated directly on a relatively thin flat terminator plate, there is a danger that the terminator plate and its associated end cap assembly can burn through. If the end cap assembly burns through, the desired gas pressurization within the sealed fuse housing which aids in arc extinction (and arises in part from fusion of the granular dielectric within the housing) is lost and arcing may continue between the terminator plates and/or cap assemblies at opposite ends of the housing.

In order to overcome this problem it is the practice to employ a construction wherein an end of a fusible element is terminated ahead of the terminator plate (i.e., in a direction axially inwardly and away from the terminator plate and its associated cap assembly) and on a component or arcing electrode of relatively great mass electrically and mechanically affixed to the terminator plate. In some prior art fuses such a component takes the form of a metal block or terminator finger affixed to a terminator plate on the side thereof facing away from the associated cap assembly and to which the fusible element is welded. As indicated above, the reason for this is at certain levels of fault current the fuse elements require relatively long arcing times to clear. If the arcing burns back the element to the termination finger, it is desirable that the mass of the finger prevent the arc from burning through to the cap assembly before the fault is cleared. If the arc does reach the cap assembly, the possibility exists that it will burn through the cap assembly before the fuse clears. If this happens, the fuse may never clear because the unsealed fuse allows gas pressure to rapidly escape which encourages the ionized gases to follow a path perpendicular to the element windings. Because of the high voltage between element turns, they can flash-over resulting in failure of the fuse to clear. While such prior art solutions result in fuses having desirable electrical properties, the solutions create fuse assembly and production problems in that welding of the fusible element (whether ribbon or wire) becomes to an arcing electrode difficult, time-consuming and costly. When attempting to resistance-weld fuse elements to the arcing electrodes (as opposed to soldering), it is difficult to physically get the welding tool electrodes into the tight configuration of the arcing electrodes because the adjacent fusible elements block the access to the next arcing electrodes. Also, the spider blocks access to the backside of the arcing electrodes. In welding it is necessary to have an electrode on each side of the termination to supply both electrical contact and pressure on the two pieces (fuse element and arcing electrode) to be welded.

SUMMARY OF THE PRESENT INVENTION

In accordance with the present invention there are provided improved means for terminating fusible elements in high voltage current-limiting cartridge-type fuses so that resistance-welding of the fusible elements is feasible while at the same time the fusible elements terminate at relatively massive arcing electrodes on the terminator plates in the fuses so as to prevent electric arcs from reaching the associated end cap assemblies in the fuses.

More specifically, the invention assumes a current-limiting fuse comprising a hollow insulating housing, electrically conductive end cap assemblies secured to opposite ends of the housing, and a dielectric assembly having electrically conductive metallic terminator plates connected at opposite ends thereof and disposed within the hollow insulating housing with each terminator plate electrically and mechanically connected to an associated end cap assembly. Each terminator plate has relatively massive arcing electrodes extending from the surface of the terminator plate remote from its associated end cap assembly.

The fusible elements which are helically wound on the dielectric assembly have the ends thereof electrically and mechanically secured to the arcing electrodes on the terminator plates. More specifically, each fusible element has an end portion folded around and in electrical contact with its associated arcing electrode and is electrically and mechanically connected by welding in such fixed position.

In one embodiment the arcing electrode has a hole therethrough through which an end portion of the fusible element extends and the end portion is welded to the arcing electrode.

In another embodiment the terminator plate has a hole therethrough through which an end portion of the fusible element extends after it is wrapped around the arcing electrode and the end portion is welded to the terminator plate.

Preferably, the arcing electrodes are integrally formed bent projections on the terminator plates.

The invention offers several advantages over the prior art. For example, the fuse elements are terminated in such a way that welding of the elements is feasible in an easy manner, yet arcing electrodes are provided to keep the arcs from reaching the end cap assemblies.

In both embodiments, during manufacture the welding electrodes can come in from the edge of the terminator plates without any obstructions.

In use, when fault interruption occurs involving burnback of the fusible elements towards the terminator plates, the arc terminates on the arcing electrodes rather than on the terminator plates resulting in a burn through the cap assemblies.

Other objects and advantages of the invention will hereinafter appear.

DRAWINGS

DESCRIPTION OF PREFERRED EMBODIMENTS

Figure 1:
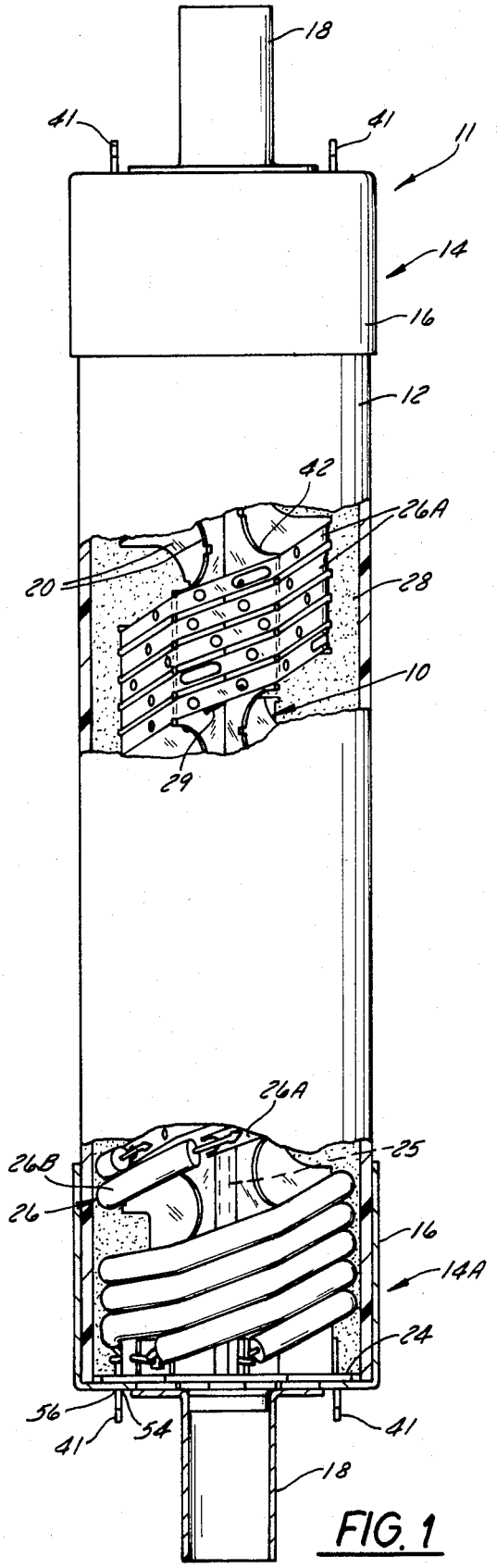
FIG. 1 is a side elevation view of a high voltage current-limiting cartridge-type fuse with portions broken away to show interior details.
Figure 2:
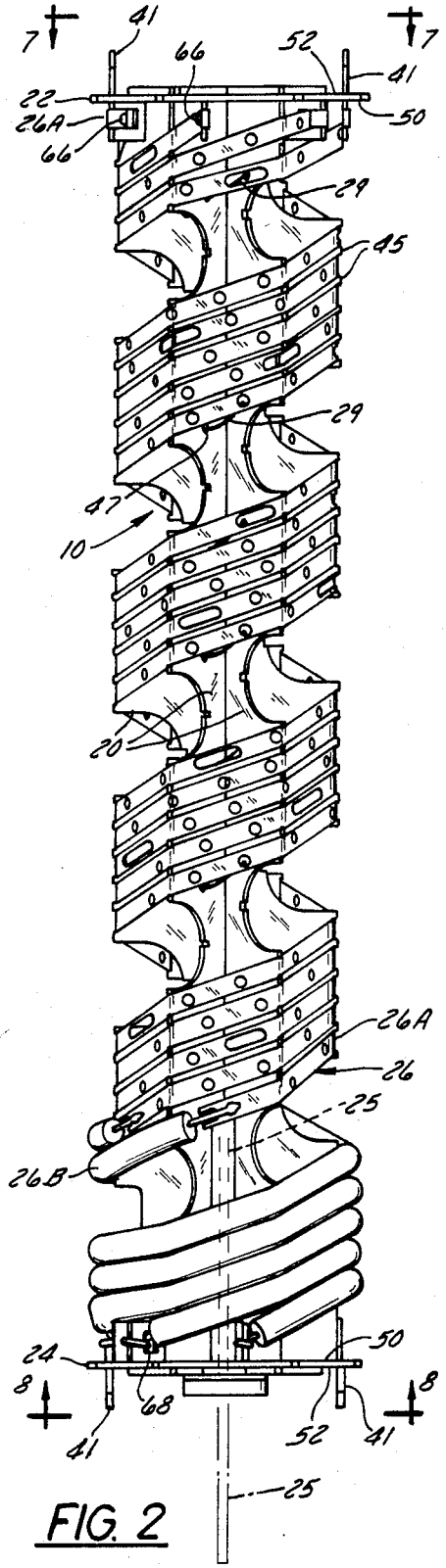
FIG. 2 is a side elevation view of the spider assembly of FIG. 1 shown removed from the fuse housing.

Referring to FIGS. 1 and 2, numeral 11 designates a high-voltage current-limiting fuse in accordance with the invention. Fuse 11 comprises a hollow cylindrical insulating housing 12 formed of dielectric material such as plastic resin; electrically conductive end cap assemblies 14 and 14A secured to opposite ends of the housing; and a multi-ribbed dielectric spider assembly 10 having electrically conductive metallic terminator plates 22 and 24 connected at opposite ends and disposed within the hollow housing 12 with each terminator plate 22, 24 electrically and mechanically connected to an associated end cap assembly 14 and 14A, respectively. Each end cap assembly 14, 14A includes a metal cap 16 mounted on an end of housing 12 in sealed relationship and has a circuit connecting member such as a tube 18. As FIGS. 1 and 2 show, a plurality (five) of fusible elements 26, each comprising a ribbon 26A and a wire 26B connected in series therewith, are helically wound on the spider assembly 10 with an end of each fusible element 26 electrically and mechanically secured to an associated terminator plate 22, 24. Each ribbon 26A is fabricated from silver or other suitable alloy and is dimensioned so as to melt when an electric current of predetermined magnitude flows through the ribbon. Wire 26B serves as to provide a full range fuse and is an optional component. As FIGS. 1, 2, 4 and 11 show, an axially movable visual indicator pin 25 is mounted on one end of the spider assembly 10 and is movable by a biasing spring 27 (see FIG. 11) from a retracted position wherein it is shown in FIGS. 1, 2, 4 and 11 and wherein it is secured by a fusible wire 29 to a tripped (fuse-blown) extended position (shown in phantom in FIG. 2) wherein it projects through aligned holes in the associated terminator plate 24 and end cap assembly 14. FIG. 1 shows granular dielectric material 28, such as silica sand or coarse sand, filling the housing and entirely surrounding the fusible elements 26.

Referring to FIGS. 2, 3, 4 and 11, the spider assembly 10 includes a plurality (three) of flat support plates 20 which are closely fitted together and held in a fixed relation with respect to each other by the conductive metallic terminator plates 22 and 24 which are provided at each end of the support plates 20. Thus, three plates 20 provide six radially extending ribs 43. The fusible elements 26 are helically wound about the outer edges of the support plates 20 and connected as hereinafter explained to the metallic plates 22 and 24 at each end of the fusible elements 26. Each support plate 20 is in the form of a flat sheet-like member formed of a suitable dielectric material such as mica paper. Slot means (not shown) are provided in each of the plates 20 and extend axially to allow the plates to be cross-fitted to form the spider assembly for the fusible elements 26, and reference may be had to U.S. Pat. No. 4,220,940 showing details of this form of construction.

Each of the plates 20 includes a plurality of support surfaces 40 along each of its two longitudinal outer edges. The support surfaces 40 are separated by means of notches 42. In a preferred embodiment, the support surfaces 40 are equally spaced along each longitudinal edge in an individual plate 20 with the support surfaces 40 on each longitudinal edge of adjacent plates 20 being offset with respect to each other and also offset with respect to the support surfaces 40 provided on each of the two other plates. As FIG. 11 best shows, each of the support surfaces 40 is separated by nibs 45 into five separate tracks 48.

Figure 3:
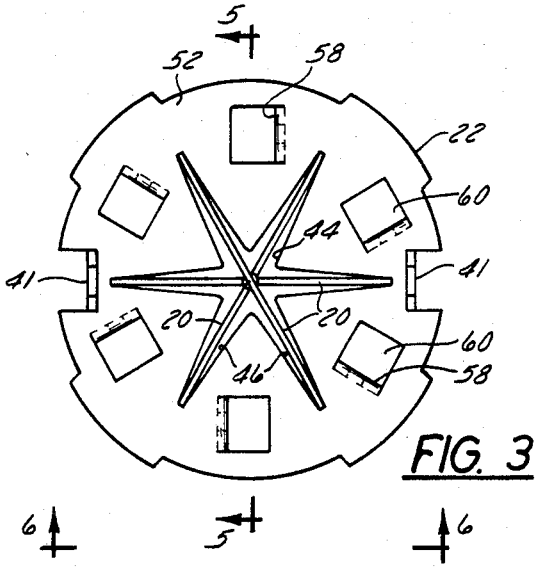
FIG. 3 is a greatly enlarged end view of one end of the spider assembly of FIG. 2 and showing details of the outer surface of one terminator plate thereof.
Figure 5:
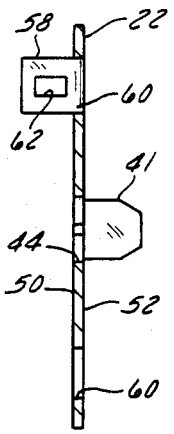
FIG. 5 is a side elevational view of a terminator plate taken on line 5—5 of FIG. 3.
Figure 4:
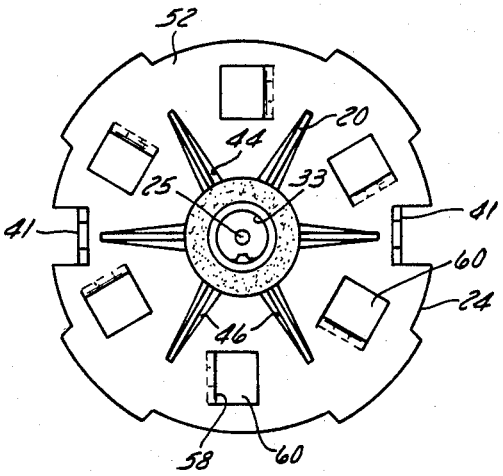
FIG. 4 is a greatly enlarged end view of the other end of the spider assembly of FIG. 2 and showing details of the outer surface of the other terminator plate thereof and an indicator pin associated therewith.

As FIGS. 3 and 4 make clear, the plates 20 of the spider assembly 10 are held in a predetermined angular relation, i.e. 120 degrees, by means of the metallic terminator plates 22 and 24. In this regard each of the terminator plates 22, 24 includes a central aperture 44 with a plurality (six) of notches 46 located 60 degrees apart to accommodate ends of the plates 20. The fusible ribbons 26A are wrapped around the support surfaces 40 in the tracks 48 in spaced relationship. The second fusible wires 26B are also helically wrapped around the support surfaces 40. Since each plate 20 is shaped differently in that the support surfaces 40 are offset axially with respect to each other, a predetermined pitch can be provided for the fusible elements 26 as they are helically wound about the assembled plates 20. The use of six ribs 43 provides a greater circular circumference and thus an increased length for the fusible elements 26 for a spider assembly 10 of the same length.

During assembly, the spider assembly 10 is positioned in the cylindrical housing 12 with the metallic terminator plates 22 and 24 secured to the end caps 16 by soldering a pair of outwardly extending tabs 41 provided on end plates 22, 24 to the end caps 16. The housing 12 is filled with the granular dielectric material 28 after one end cap assembly 14A is in place.

Referring to FIGS. 1, 2, 3, 4, 5, 6, 7, 8, 11 and 12, each terminator plate 22, 24 takes the form of a generally circular relatively thin electrically conductive disc fabricated, as by punching or stamping, from a sheet of high conductivity copper or similar material. Each plate 22, 24 is mounted on and perpendicular to the axis of the fuse 11 and has an inner surface 50 facing inwardly toward the interior fuse and an outer surface 52 facing away from the interior of the fuse. Each plate 22, 24 includes a pair of integrally formed tabs 41 whereby the plate is connected to an end cap 16 as by soldering at 54 where the tabs 41 extend through slits 56 formed in the end caps 16. Each plate 22, 24 also includes a plurality (six) of arcing electrodes 58 which take the form of integrally formed punched and bent projections extending at right angles to and inwardly from the inner surface 50 of the plates 22, 24. Each plate 22, 24 thus has a hole 60 adjacent to an arcing electrode 58. Furthermore, each arcing electrode 58 has a hole 62 punched therethrough. Each projection 58 has its larger planar surfaces lying in planes which radiate from the axis of the fuse 11.

Figure 9:
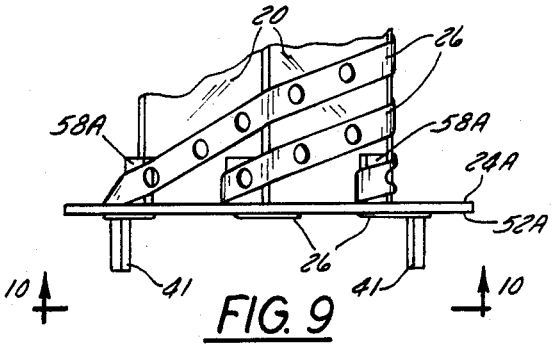
FIG. 9 is a partial view similar to that of FIG. 2 and showing an alternative way of securing a ribbon-type fusible element to an arcing terminal.
Figure 10:
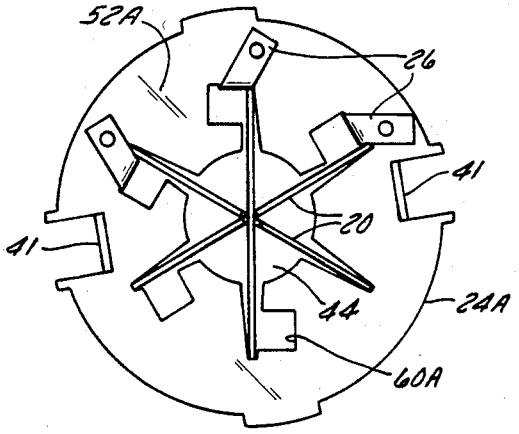
FIG. 10 is a view similar to FIG. 7 but taken on line 10—10 of FIG. 9 and showing the alternative way of securing the ribbon-type element.

FIGS. 9 and 10 show an embodiment of the invention wherein a terminator plate 24A, generally similar to plate 22 for example, comprises tabs 41 and a plurality of arcing electrodes 58A which have their planar surfaces lying in planes which are perpendicular to lines radiating from the axis of the fuse 11. Plate 24A has a hole 60A adjacent to an arcing electrode 58A but no hole is provided in an arcing electrode 58A.

Each fusible element 26 which is helically wound on the dielectric spider assembly 10 has an end thereof electrically and mechanically secured to an arcing electrode 58 (or 58A) on a terminator plate 22, 24 or 24A, respectively. More specifically, each fusible element 26 has an end portion folded around and in electrical contact with its associated arcing electrode and is electrically and mechanically connected by welding in such fixed position.

Figure 7:
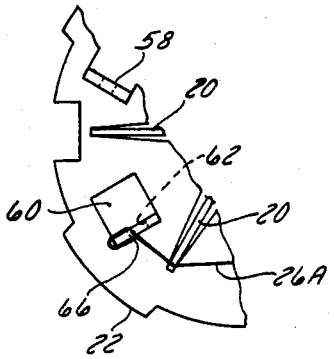
FIG. 7 is a view taken on line 7—7 of FIG. 2 and showing the manner in which a ribbon-type fusible element is connected to an arcing terminal on one terminator plate.
Figure 6:
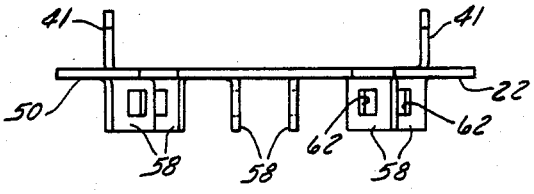
FIG. 6 is a view similar to FIG. 5 but taken on line 6—6 of FIG. 3.
Figure 8:
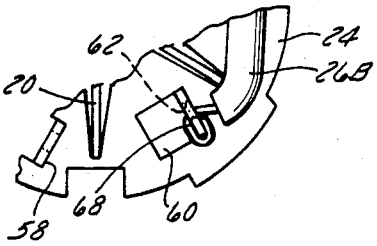
FIG. 8 is a view taken on line 8—8 of FIG. 2 and showing the manner in which a wire-type fusible element is connected to an arcing terminal on another terminator plate.

In the embodiments shown in FIGS. 1 through 8, each arcing electrode 58 has a hole 62 therethrough through which an end portion of the fusible element 26 extends and the end portion is welded to the arcing electrode. FIGS. 2 and 7 show an end portion of flat ribbon 26A extending through hole 62, folded and spot welded as at 66 (see FIG. 2). FIGS. 2 and 8 show an end portion of wire 26B extending through hole 62, folded and spot welded as at 68 (see FIG. 2).

In the embodiment shown in FIGS. 9 and 10, the end portion of fusible element 26 extends past and against the outside surface of an arcing electrode 58A, is inserted downwardly through opening 60A in plate 24A and is folded back and flat against the outside surface 52A of plate 24A to which it is welded.

Each arrangement or embodiment shown enables the fusible element 26 and either the projection 58 or the plate 24A to be gripped between two oppositely disposed closable resistance welding electrodes (not shown) by means of which the end of the fusible element 26 is welded into position.

In use, when fault interruption occurs involving burnback of the fusible elements 26 towards the terminator plates 24 and 22 (or 22A), the arc terminates on the arcing electrodes 58 (or 58A) rather than on the terminator plates 24, 22, 22A resulting in a burn through the cap assemblies 14. This is due to the fact that the arcing electrodes have relatively large mass relative to the terminator plates and extend axially inwardly and away from the terminator plates.

Figure 12:
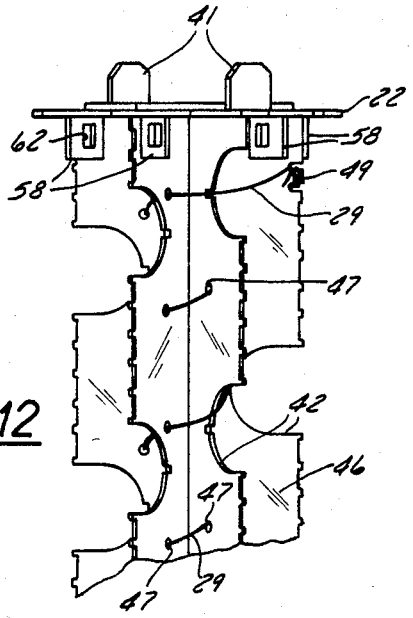
FIG. 12 is a view similar to FIG. 11 but showing a portion of another side of the spider assembly.
Figure 11:
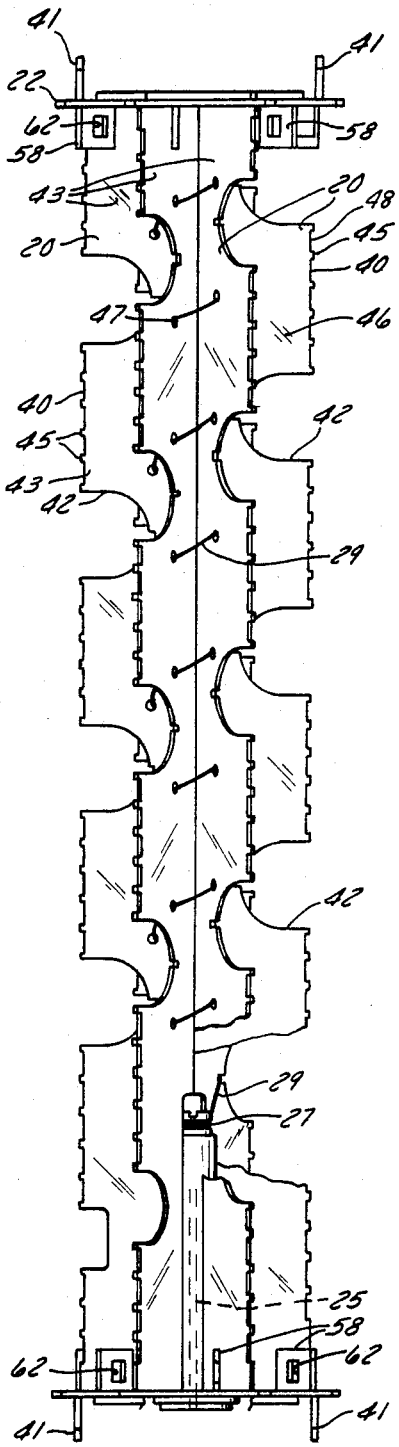
FIG. 11 is a view similar to FIG. 2 but showing the spider assembly prior to attachment of the fusible element and showing the manner in which the pin-restraining wire is mounted.

Referring now to FIGS. 2, 11 and 12, the fusible wire 29 for securing the indicator pin 25 has one end mechanically secured to the pin 25, is helically wound through axially spaced apart holes 47 formed in the ribs 43 of the spider assembly 10, and has its other end mechanically anchored to a rib 49 (see FIG. 12) in the spider assembly 10. The fusible pin-restraining wire 29 is fabricated of high-resistance material such as nichrome and is helically wound around and supported on the dielectric assembly 10 radially inwardly of the aforesaid fuse elements 26 which are helically wound around assembly 10. Wire 29 operates to secure the indicator pin 25 in its retracted position against the bias of the biasing spring means 27. As FIGS. 11 and 12 show, one end of pin-restraining wire 29 is connected to the indicator pin 25 and the other end of the pin-restraining wire is connected to the dielectric assembly at 49. The pin-restraining wire 29, when fused or burned through as a result of vaporization of the fusible fuse elements 26, enables the indicator pin 25 to move to tripped position. The pin-restraining wire 29 preferably takes the form of several strands of resistance wire such as nichrome or the like and is helically wound around the dielectric assembly on the interior of the fusible fuse element (which is helically wound around the exterior of the dielectric assembly). Thus, the pin-restraining wire 29 is of greater length than if it were merely arranged in a straight line and is of greater electrical resistance. Thus, end remnants of the pin-receiving wire 29 are of such a length as to prevent arcing from occurring between the remaining end of the pin-restraining wire and the indicator pin 25. The helically arranged wire 29 being of greater length than a straight wire has greater electrical resistance and greater ability to withstand high-voltage flash-over when severed. The wire 29 is physically close to the fusible elements 26 at its connection point 49 and this permits it to be switched into the circuit only after the main element is blown or severed, thereby increasing its reliability.

In a preferred embodiment of the invention disclosed herein, the dielectric assembly 10 takes the form of a spider assembly comprised of the insulating plates 20, hereinbefore described, which are arranged in a predetermined angular relationship. The plates 20 define radially extending ribs 43 around which the fusible elements 26 are helically wound, and the ribs 43 are each provided with the holes 47 spaced apart axially along each rib and through which the pin-restraining wire is helically threaded. Thus, the wire 29 is inwardly spaced from and electrically insulated from the fusible element 26.

Each set of six radially extending support surfaces 40 accommodates a single turn of a single fuse element 26. In the embodiment shown, each fuse element 26 is thus wound at some predetermined pitch (determined by the spacing of the support surfaces 40) to provide a predetermined number of turns, i.e., seven turns being shown.

However, for each support surface 40 there are two holes 47 in the associated rib 43. Thus, the pin-restraining wire 29 is wound at a smaller pitch than each fuse element 26 and provides a number of turns greater than the predetermined number of turns of each fuse element 26, i.e., twice as many turns. Thus, pin-restraining wire 29 is substantially longer than a single fuse element 26. The two holes 47 are spaced radially inwardly from the associated support surface 40 sufficiently far so as to space the pin-restraining wire 29 sufficiently far from the associated fuse element 26 wound therearound to maintain a dielectric distance and prevent high-voltage breakdown therebetween. Since each support surface 40 is very thin, there is no tendency for portions of wire 29 to remain lodged and unburned in a hole 47 when the fuse has blown to serve as an electrically conductive flash-over point.

We claim:

1. A current-limiting fuse comprising: a hollow insulating housing having a longitudinal axis;

electrically conductive end cap assemblies secured to opposite ends of said housing;

a dielectric assembly; electrically conductive metallic terminator plates connected at opposite ends of said dielectric assembly and disposed within said hollow insulating housing with each terminator plate being disposed transversely of said axis and electrically and mechanically connected to an associated end cap assembly, each of said plates having one surface confronting an associated end cap assembly and an opposite surface;

at least one of said terminator plates having integrally formed means on said one surface in electrical contact with said associated end cap assembly and having at least one integrally formed arcing electrode extending axially from said opposite surface;

and at least one fusible element helically wound on said dielectric assembly and having the opposite ends thereof electrically and mechanically secured to said terminator plates;

said fusible element having an end portion folded around in fixed position and in electrical contact with said arcing electrode and extending through a hole in said one terminal plate and electrically and mechanically connected by welding in said fixed position to said one terminator plate.

2. A fuse according to claim 1 wherein said arcing electrode has a hole therethrough through which said end portion of said fusible element extends and wherein said end portion is welded to said arcing electrode.

3. A fuse according to claim 1 wherein said one terminator plate has a hole therethrough adjacent said arcing electrode and through which said end portion of said fusible element extends and wherein said end portion is welded to said one surface of said one terminator plate.

4. A fuse according to claim 2 or 3 wherein said means and said arcing electrode each comprise an integrally formed bent projection on said one terminator plate.

5. A fuse according to claim 4 which comprises a plurality of fusible elements and wherein said one terminator plate is provided with a plurality of arcing electrodes which are disposed in radial arrangement around said longitudinal axis.

6. A fuse according to claim 2 wherein said dielectric assembly comprises at least one dielectric plate which lies in a first plane which radiates from said axis and wherein said arcing electrode is wider than it is thick and has its wider planar surfaces generally lying in other planes which radiate from said axis and are spaced from said first plane.

7. A fuse according to claim 3 wherein said dielectric assembly comprises at least one dielectric plate which lies in a first plane which radiates from said axis and wherein said arcing electrode is wider than it is thick and has its wider planar surfaces generally lying in other planes which are transverse to said first plane, said arcing electrode being in edge-abutting relationship to said one dielectric plate.

* * * * *